US009567855B1

(12) United States Patent
Kundel

(10) Patent No.: US 9,567,855 B1
(45) Date of Patent: Feb. 14, 2017

(54) HYDRAULIC CYLINDER SAFETY STOP

(71) Applicant: Robert Kundel, Vienna, OH (US)

(72) Inventor: Robert Kundel, Vienna, OH (US)

( * ) Notice: Subject to any disclaimer, the term of this patent is extended or adjusted under 35 U.S.C. 154(b) by 649 days.

(21) Appl. No.: 14/063,262

(22) Filed: Oct. 25, 2013

(51) Int. Cl.
*F01B 25/00* (2006.01)

(52) U.S. Cl.
CPC ..... *F01B 25/00* (2013.01)

(58) Field of Classification Search
CPC ..... F15B 15/26; F15B 11/12; F15B 11/10; F01B 25/00
USPC .... 92/15, 17, 18, 19, 20, 21 MR, 22, 23, 24
See application file for complete search history.

(56) References Cited

U.S. PATENT DOCUMENTS 2,932,282 A * 4/1960 McKinley ..... E02F 9/2203 91/45
8,733,510 B2 * 5/2014 Haase ..... F15B 15/261 188/300
2006/0100075 A1 * 5/2006 Harsh ..... A63B 21/0724 482/142

* cited by examiner

*Primary Examiner* — Eric Keasel
*Assistant Examiner* — Abiy Teka
(74) *Attorney, Agent, or Firm* — Harpman & Harpman

(57) ABSTRACT

A safety device for maintaining a load raised cylinder linkage in selected extended position. A combination cylinder engagement rod and locking sleeve with a piston rod engagement channel that will adjustably secure and extended piston rod from a cylinder assembly in a safe secure locked extended position. The cylinder safety stop of the invention is interposed between the cylinder sleeve and the piston end block by the incrementally adjustable engagement panel's positioning via removably positioned stop adjustment pin. An intermediate incrementally adjustable fitting provides for positioning between multiple aligned stop pin engagement apertures.

6 Claims, 5 Drawing Sheets

HYDRAULIC CYLINDER SAFETY STOP

BACKGROUND OF THE INVENTION

1. Technical Field

This invention relates to piston and cylinder stops that secure the piston rod when it is in extended position to prevent accidental deactivation of the piston and cylinder assembly when in extended support linkage load bearing engagement.

2. Description of Prior Art

Prior art devices of this type have been directed to a variety of cylinder locks that will engage the piston and cylinder and keeping it from retracting unintentionally. See for example U.S. Pat. Nos. 4,043,253, 4,122,758, 4,483,564 and 4,947,705.

In U.S. Pat. No. 4,043,253 a boom cylinder stop for lift cylinders is disclosed having a tubular bearing mounted on the rod so that when extended it will drop down and engage the cylinder holding same in place.

U.S. Pat. No. 4,122,758 is directed to a service support wherein a U shaped bracket is bolted to an extended lift rod, locking it in place.

U.S. Pat. No. 4,483,564 claims an oil well sucker rod safety block formed of a slotted pipe with a handle that is positioned over the well spring and held in place by end caps and engagement of the string thereon.

U.S. Pat. No. 4,947,705 discloses a method and apparatus for maintaining a load raising linkage in raised position. The device comprises a locking member pivoted between an unlocked position and a locking position over the extended piston rod.

SUMMARY OF THE INVENTION

A safety apparatus for engaging and holding a piston rod and cylinder assembly in extended and locked position preventing accidental or unintentional retraction of the piston rod. The device has a cylinder end engagement locking sleeve plate with an intermediate adjustable fitting extending therefrom. An elongated piston rod engagement channel is slidably disposed over the piston rod and has a plurality of longitudinally and transversely aligned apertures formed therein. A stop pin is selectively repositioned through aligned apertured pairs for registration with the cylinder end engagement locking sleeve plate securing the rod engagement channel against the piston rod and block preventing the piston rod from unintentional retraction into the cylinder.

DETAILED DESCRIPTION OF THE INVENTION

Figure 1:
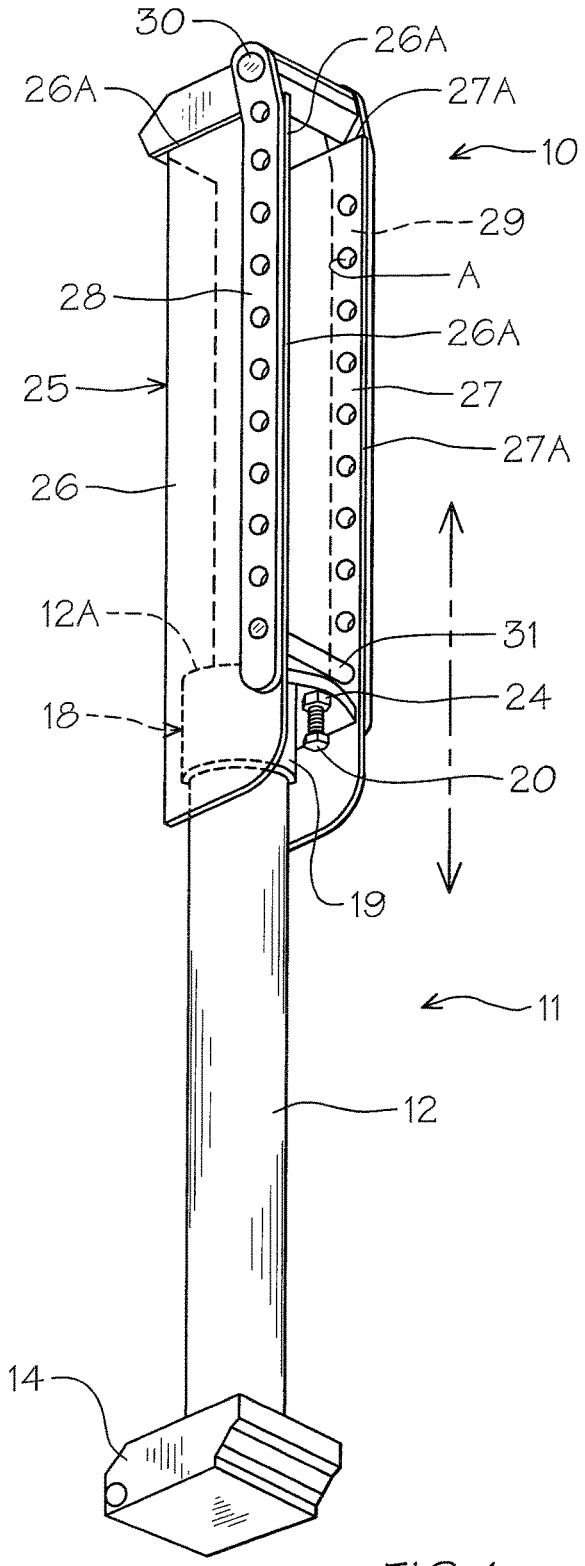
FIG. 1 is a perspective view of the cylinder stop in engaged and lock extended position.

Referring to FIG. 1 of the drawings, the cylinder safety stop 10 of the invention can be seen engaged on a piston and cylinder assembly 11 which has a cylinder body 12 with a piston rod 13 reciprocally positioned therein. The cylinder body 12 extends from and is integral with a cylinder base block 14 having fluid supply attachment portal fittings 15 for connection with a source of fluid under pressure PS as is well known and understood within the art.

The piston rod 13 has a piston rod block 16 secured to its free end, having a bore 17 extending transversely therethrough which provides a point of attachment for the cylinder safety stop 10 as will be described in detail hereinafter.

The cylinder safety stop 10 of the invention has a cylinder end engagement locking sleeve fitting 18, best seen in FIGS. 1 and 3-6 of the drawings. The locking sleeve fitting 18 has a main body member 19 with an integral engagement plate 20 extending from its upper end surface 21. The engagement plate 20 has an annular opening at 22 sized for allowing the piston rod 13 to pass therethrough when the cylinder end engagement locking sleeve 18 is attached to the free end 12A of the cylinder body 12.

An adjustment stop bolt 23 is threadably disposed through the engagement plate 20 with a lock nut 24 positioned thereon. The adjustable bolt 23 can be rotatably advanced thereby extending above the plate's 20 planar upper surface 20A for adjustable stop engagement as will be described hereinafter.

An elongated U-shaped piston rod block engagement channel 25 is slidably positioned on the piston rod 13 of the cylinder assembly 11 having a plurality of longitudinally and transversely aligned apertures A along the respective edges of the channels upstanding sidewalls 26 and 27, best seen in FIG. 1 of the drawings. In this primary form of the invention a pair of correspondingly aligned and apertured overlying reinforcement brackets 28 and 29 are secured respectively thereto and extend beyond the respective sidewall ends 26A and 27A with angularly offset portions 28A and 29A, best seen in FIGS. 1 and 2 of the drawings. The offset bracket portions 28A and 29A provide for end apertured aligned registration with a piston block pin 30 extending from the piston block bore 17 respective openings as hereinbefore described. The transversely aligned wall apertures A also provide for selective insertion of a removable stop lock pin 31 therethrough for in use engagement with the hereinbefore described engagement plate 20's upper planar surface 20A and alternately the adjustment bolt 23 in registerable alignment therewith of the cylinder and engagement locking sleeve 18.

Figure 2:
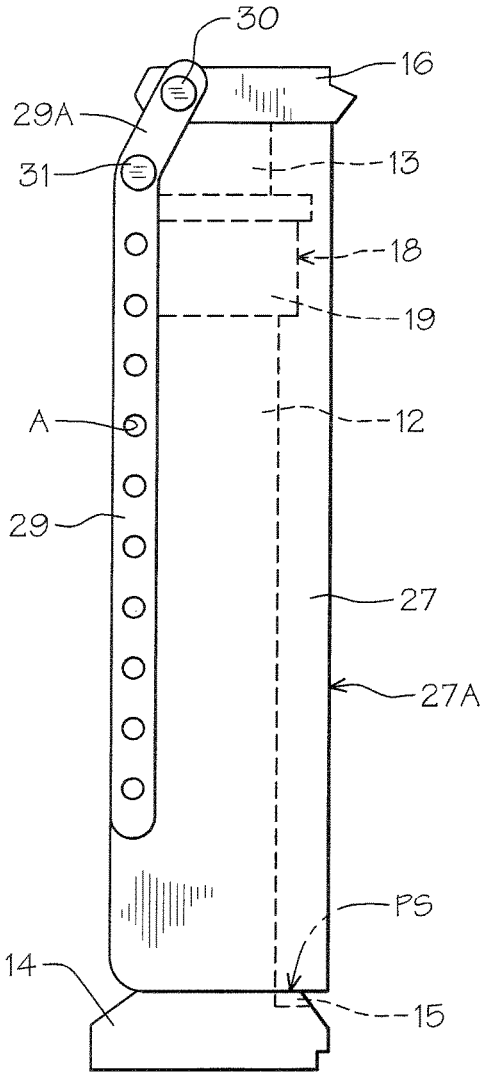
FIG. 2 is a side elevational view of the cylinder stop in engaged piston rod retracted position.
Figure 3:
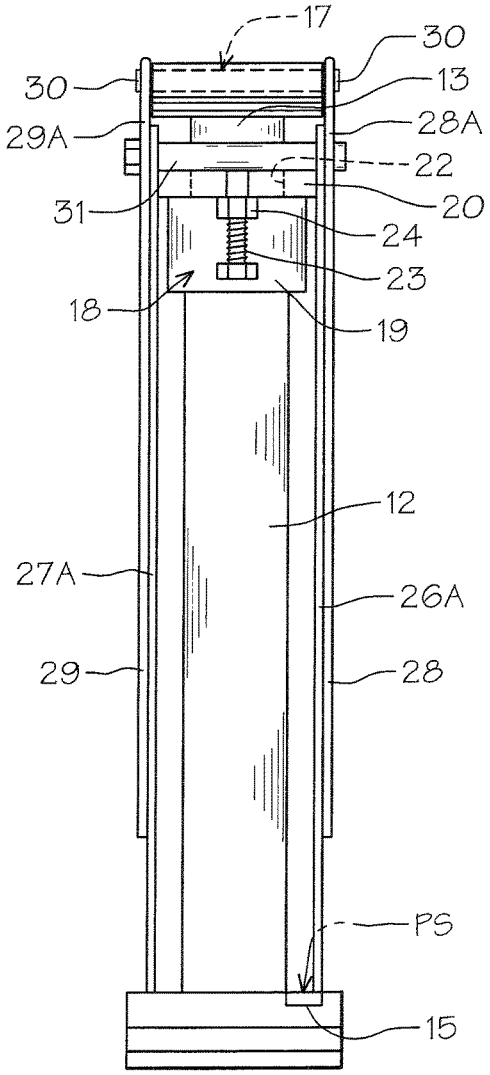
FIG. 3 is a front elevational view thereof.

Referring now to FIGS. 1, 2 and 3 of the drawings, it will be seen that once the cylinder safety stop 10 of the invention has been initially positioned and secured on the piston and cylinder assembly 11 by engagement of the piston block pin 30 through the respective apertured angularly offset portions 28A and 29A of the reinforcement brackets 28 and 29 and that the stop lock pin 31 extend through aligned apertures A will initially rest on the engagement plate 20 when the piston rod 13 is in fully retracted (rest) position within the cylinder 12 as seen in FIGS. 2 and 3 of the drawings.

Once installed and in use, upon activation the piston and cylinder assembly 11, the piston rod 13 will extend pulling the engagement channel 25 therewith to the desired extended rod position as seen in FIG. 1 of the drawings. The stop lock pin 31 will be repositioned through the appropriate aligned sidewall apertures A and inserted. The stop lock pin 31 will now, therefore, once again engage the upper surface 20A of the engagement plate 20 preventing the piston rod 13 from retracting, effectively locking the cylinder and piston assembly 11 in a fail safe extended position.

It will be seen that the adjustment bolt 23 can be rotatably advanced from within the sleeve plate 20 and secured in place by the locking nut 24 providing for incremental fine extending adjustment to match the actual extended piston rod 13 position if it falls between the hereinbefore described aligned sidewall apertures A assuring incremental locking engagement of the piston rod 13 at any effective extended position.

Figure 7:
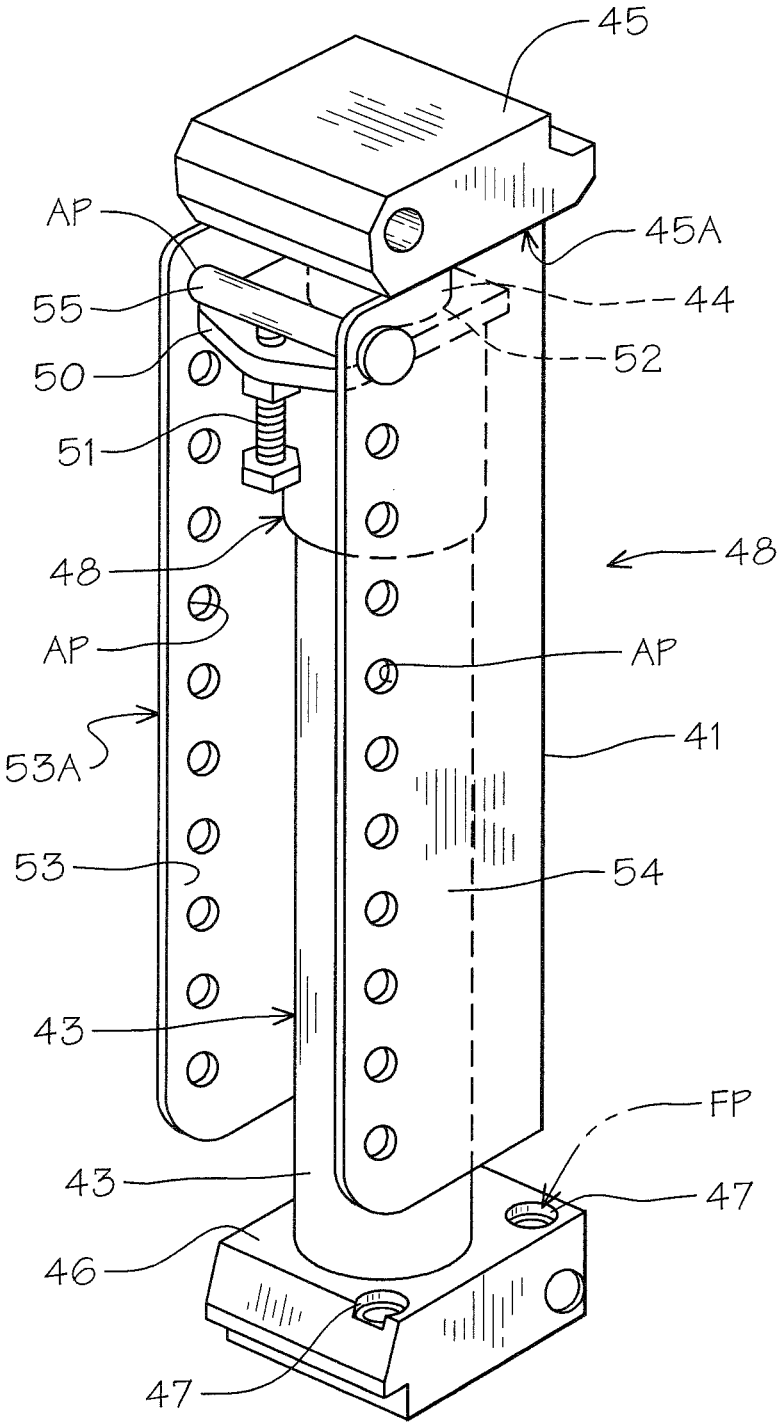
FIG. 7 is a perspective view of an alternate form of the cylinder stop of the invention in engaged cylinder piston rod position.
Figure 8:
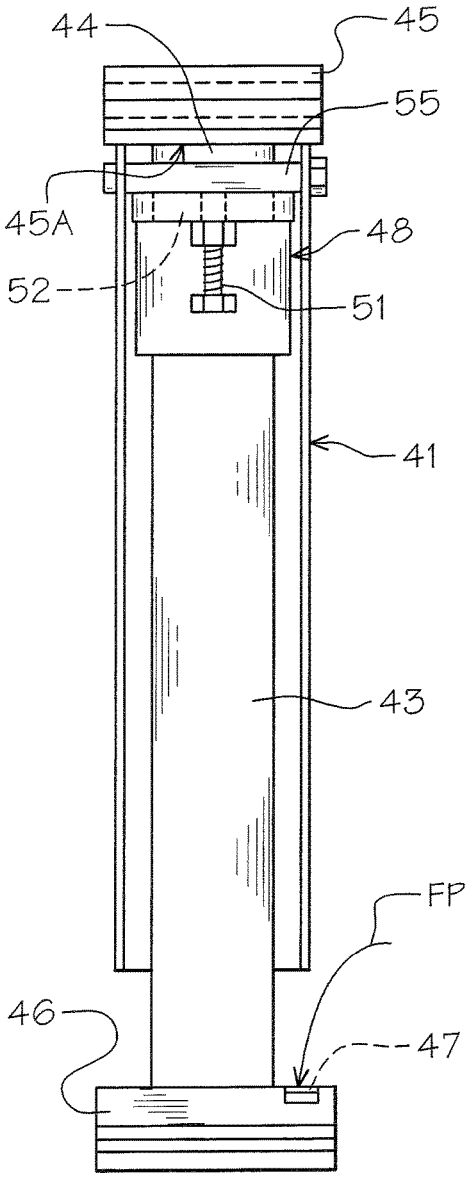
FIG. 8 is a front elevational view thereof.
Figure 9:
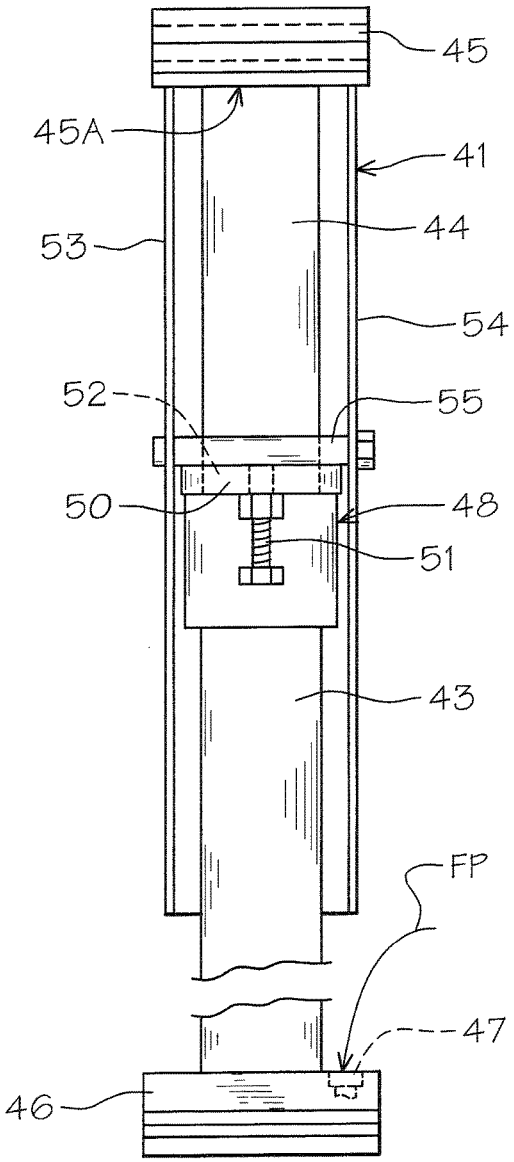
FIG. 9 is a front elevational view in cylinder extended and locked position.

Referring now to FIGS. 7, 8 and 9 of the drawings, an alternate form of the cylinder safety stop lock of the invention can be seen at 40 wherein a modified elongated U-shaped piston rod lock engagement channel 41 can be seen positioned on a piston and cylinder assembly 42 having a cylinder body 43 and a piston rod 44 with a piston rod end block 45 secured thereto.

The cylinder body 43 has a cylinder body block 46 with fluid attachment portal fittings 47 as will be well understood by those skilled in the art for a supply of fluid under pressure indicated graphically at arrow FP.

Figure 4:
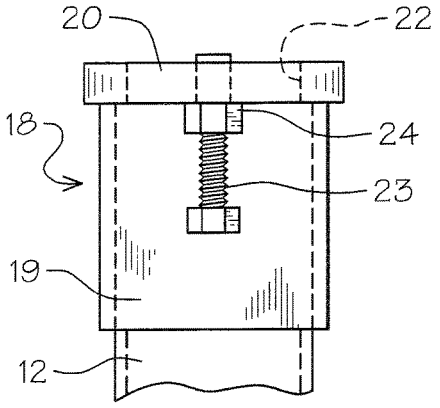
FIG. 4 is a front elevational view of a cylinder end engagement locking sleeve fitting.
Figure 5:
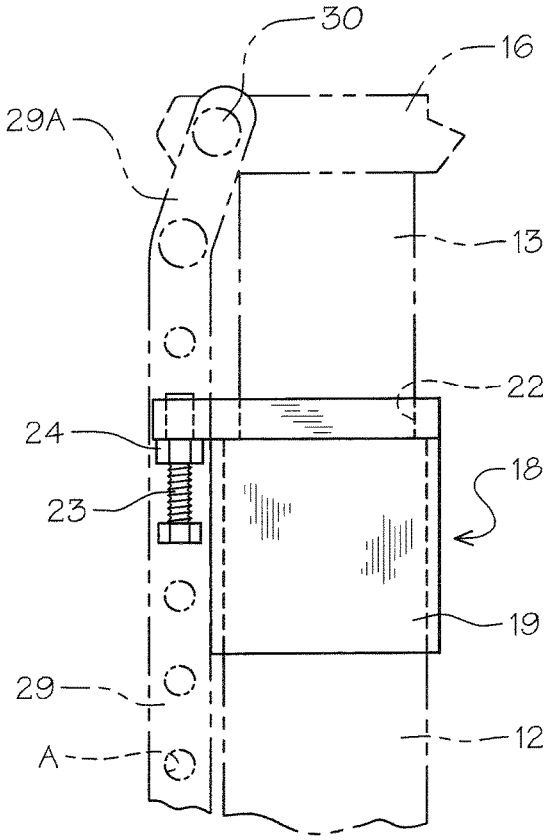
FIG. 5 is a side elevational view of the cylinder end engagement locking sleeve with piston rod engagement channel portion shown in broken lines.
Figure 6:
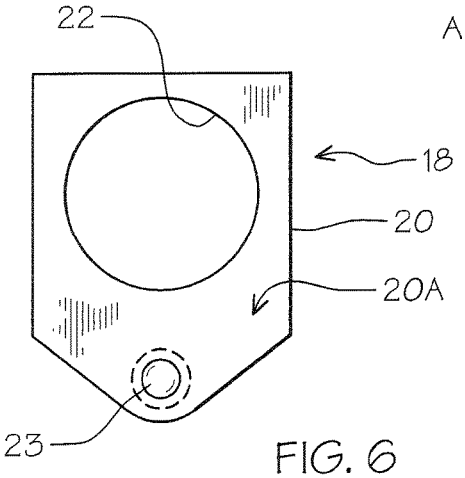
FIG. 6 is a top plan view thereof.

A cylinder end engagement attachment fitting 48 which is identical to that of the hereinbefore described cylinder end engagement locking sleeve fitting 18 with a corresponding engagement plate 50, fine adjustment bolt 51 and off center opening at 52 for the piston rod 44 to pass therethrough when activated. The elongated U-shaped piston rod engagement channel 41 having spaced parallel apertured sidewalls 53 and 54 has a corresponding stop lock pin 55 removably positioned through the aligned apertured pairs AP extending in longitudinally and spaced aligned rows adjacent the edges of the respectively described sidewalls 53 and 54 as best seen in FIGS. 1 and 4 of the drawings in non-activated engagement position.

It will therefore be evident that the stop lock pin 55 once positioned will registerably engage on the engagement plate 50 and the piston rod and lock engagement channel 41 will abut the bottom surface 45A of the piston rod end block 43. This orientation functions as a locking feature can be seen in FIG. 9 of the drawings wherein the piston rod 44 and its end block 43 have been extended showing the cylinder stop lock 40 registerably secured between the piston rod end block 45 and the cylinder engagement attachment fitting 48 by engagement of the lock stop pin 55 securing the piston rod 44 in a fail safe lock extended fail safe lock position.

It will be evident from the above referred to description that while the alternate form of the invention is manually utilized, certain applications would be suitable for same while the primary form of the invention provides a self-deploying system for different applications.

It will therefore be seen that a new and novel cylinder safety stop has been illustrated and described providing for multiple forms 10 and 40 for adaptable integrated use. It will be evident to those skilled in the art that various changes and modification may be made thereto without departing from the spirit of the invention.

Therefore I claim:

1. A hydraulic piston and cylinder safety stop for selectively securing a piston rod in extended position from a cylinder body comprises, an elongated apertured channel receivable around the cylinder body of the piston and cylinder and secured to a piston rod end block, said apertured channel having oppositely disposed spaced parallel sidewalls, a plurality of longitudinally spaced and transversely aligned apertures in said sidewalls, a locking sleeve secured on the free end of said cylinder body, a stop pin selectively secured through said aligned apertured channels in spaced relation to said piston rod end block, and an adjustment element on and extending from said locking sleeve for selectively positioning said stop pin engagement position in spaced relation to said locking sleeve.

2. The hydraulic piston and cylinder safety stop set forth in claim 1, wherein said locking sleeve comprises, a cylinder engagement body member, a stop pin engagement plate extending from said cylinder engagement body member, and an annular opening in said stop pin engagement plate for said piston rod to extend therethrough.

3. The hydraulic piston and cylinder safety stop set forth in claim 1, wherein said adjustment element for selectively positioning engagement with said stop pin comprises, a threaded bolt extending incrementally from said locking sleeve engageable with said stop pin.

4. The cylinder safety stop set forth in claim 1 wherein said elongated engagement channel around said cylinder body engageable with said piston rod end block, further comprises, a pair of apertured reinforcement brackets extending from said elongated channel end and registerable with said piston rod and block.

5. The hydraulic piston and cylinder safety stop set forth in claim 4, wherein said apertures in said reinforcement brackets are in overlying aligned registration with said longitudinally spaced and transversely aligned apertured in each of said respective sidewalls.

6. An elongated safety stop device for use with an extensible hydraulic piston and cylinder having a cylindrical body and a piston rod, said safety stop device comprising, an elongated apertured channel movable on said hydraulic cylinder body engageable and secured to a piston rod end block on said piston rod, a sleeve fitting secured on the cylindrical body, a stop pin removably positioned through aligned apertures in said elongated apertured channel for engagement with said sleeve fitting, and an adjustment element extending from said sleeve fitting selectively engaged by the stop pin.

* * * * *